United States Patent [19]

Allen

[11] Patent Number: 4,666,127

[45] Date of Patent: May 19, 1987

[54] WINCH SYSTEM

[76] Inventor: John Allen, 46, Otterburn Gardens, Low Fell, Gateshead, England

[21] Appl. No.: 815,658

[22] Filed: Dec. 30, 1985

Related U.S. Application Data

[63] Continuation of Ser. No. 605,293, Apr. 30, 1985, abandoned.

[51] Int. Cl.[4] ..... B66D 1/12; B66D 1/26; B63B 27/32

[52] U.S. Cl. ..... 254/281; 254/292; 254/900; 254/903; 414/138

[58] Field of Search ..... 254/219, 281, 284, 285, 254/286, 292, 293, 326, 327, 335, 336, 337, 900, 903, 274, 280; 414/139, 138

[56] References Cited

U.S. PATENT DOCUMENTS

| | | | |
|---|---|---|---|
| 685,579 | 10/1901 | Delaney | 414/138 |
| 2,634,099 | 4/1953 | O'Leary | 254/274 X |
| 3,261,591 | 7/1966 | Campbell et al. | 254/900 X |
| 3,312,452 | 4/1967 | Butler et al. | 414/138 X |
| 3,476,361 | 11/1969 | Herchenröder | 254/900 X |
| 3,500,764 | 3/1970 | Warman | 254/274 X |
| 3,661,090 | 5/1972 | Martin et al. | 254/277 X |
| 3,675,794 | 7/1972 | Ingram et al. | 414/138 |
| 3,707,922 | 1/1973 | Dillon | 414/138 X |
| 3,713,548 | 1/1973 | Hanke | 254/900 X |
| 3,787,031 | 1/1974 | Lucas | 254/281 X |
| 3,971,545 | 7/1976 | Warman | 254/280 X |

FOREIGN PATENT DOCUMENTS

| | | | |
|---|---|---|---|
| 1286870 | 8/1972 | United Kingdom | 254/900 |

*Primary Examiner*—Stuart S. Levy
*Assistant Examiner*—Joseph J. Hail, III
*Attorney, Agent, or Firm*—Rosen, Dainow & Jacobs

[57] ABSTRACT

A payload can be transferred between two relatively movable stations for example two ships using a winch system having an inhaul winch and an outhaul winch. The barrel of the outhaul winch is driven by an outhaul motor through a torque convertor such that the outhaul winch provides pull on the trolley 16 regardless of the sense of rotation of the outhaul winch barrel. A control system is used to control the speed of the inhaul winch barrel either to retrieve cable or to pay out cable. Thus, the speed of the trolley 16 is controlled by the speed at which the inhaul winch barrel is driven. The outhaul winch either can be at the same station as the inhaul winch or can be at the opposite station to the inhaul winch.

4 Claims, 3 Drawing Figures

WINCH SYSTEM

This application is a continuation of application Ser. No. 605,293, filed Apr. 30, 1985 now abandoned.

BACKGROUND OF THE INVENTION

The invention relates to winch systems for hauling payloads between relatively movable stations such as two ships, for example.

Winch systems are known for hauling payloads between a supply ship and a receiving ship. The payload is supported on a trolley or pulley block running on a cable extending between the ships and is hauled along the cable by the winch system which comprises an inhaul winch for hauling towards the supply ship and an outhaul winch for hauling towards the receiving ship. The winches are either both on the supply ship or the outhaul winch may be on the receiving ship and the inhaul winch on the supply ship.

It has been proposed to control the speed of movement of the trolley or block by controlling the speed of first one winch then both winches and finally the other winch as the payload is traversed. Such control was proposed to be achieved by governing the winch payout rate of the or each winch concerned.

SUMMARY OF THE INVENTION

The invention provide a simpler means of achieving suitable speeds of haulage.

A winch system, according to the invention, comprises an inhaul winch and an outhaul winch each having a barrel driven by a motor, a control means for controlling the speed of said barrel of said inhaul winch, support means for supporting a payload and a cable arrangement connected to said support means and having end portions wound around respective barrels of said winches, said outhaul winch motor driving said outhaul winch barrel through a torque converter such that said outhaul winch provides pull on said support means regardless of the sense of rotation of said outhaul winch barrel, said control means controlling the speed of said inhaul winch barrel to control the speed of said support means.

The outhaul winch motor may have two speed settings, or be of multispeed or variable speed type so that a higher setting may be used optionally when the outhaul winch barrel is winding a cable, or as appropriate to the load being handled, to the environmental conditions, or when the system is unloaded.

The outhaul winch barrel may be driven by the torque converter through change-speed gearing so that a relatively higher speed of rotation of the outhaul winch barrel is available optionally in order to suit different loads of differing environments, or when the system is unloaded.

BRIEF DESCRIPTION OF THE DRAWINGS

A winch system will now be described to illustrate the invention by way of example with reference to the accompanying drawings, in which.

DESCRIPTION OF THE PREFERRED EMBODIMENTS

Figure 1:
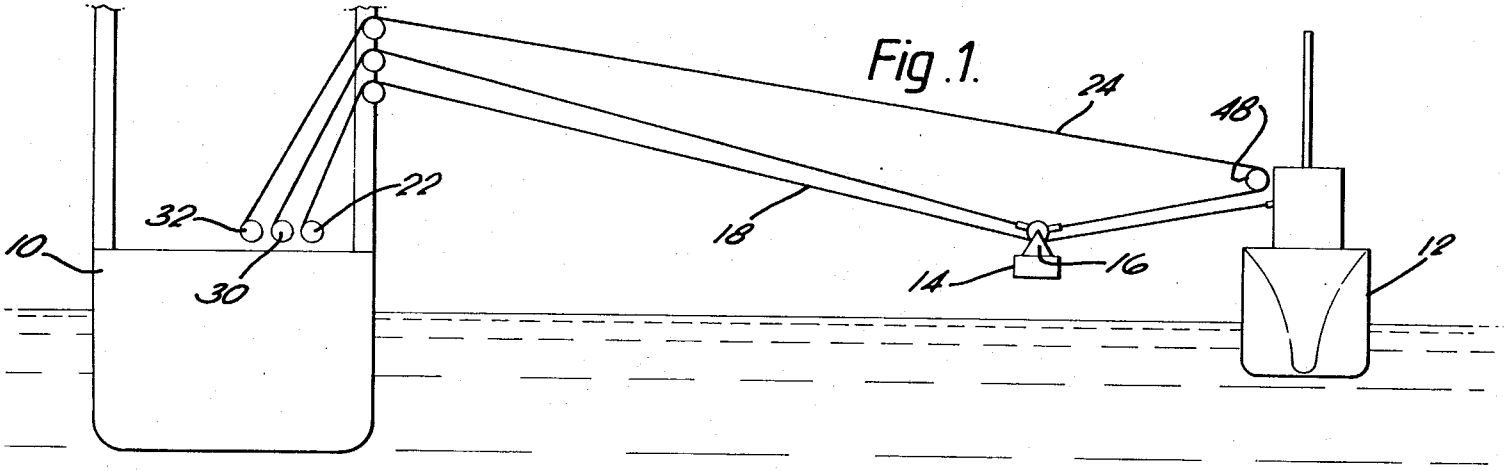
FIGS. 1 and 3 are schematic diagrams showing two alternative ways in which the winch system may be applied.

FIG. 1 shows a supply ship 10 and a receiving ship 12 between which a payload 14 is required to be transferred at sea. The payload 14 is supported by a trolley 16 running on a jackstay cable 18 having one end attached to the ship 12 and the other end wound round a barrel 22 of an auto-tensioning winch 20 (see FIG. 2) on the supply ship 10.

The trolley 16 is connected by a cable arrangement 24 to inhaul and outhaul winch barrels 30, 32, respectively, of inhaul and outhaul winches 26, 28 (see FIG. 2) on the supply ship 10. The cable 24 passes around a pulley 48 on the receiving ship 12.

Figure 3:
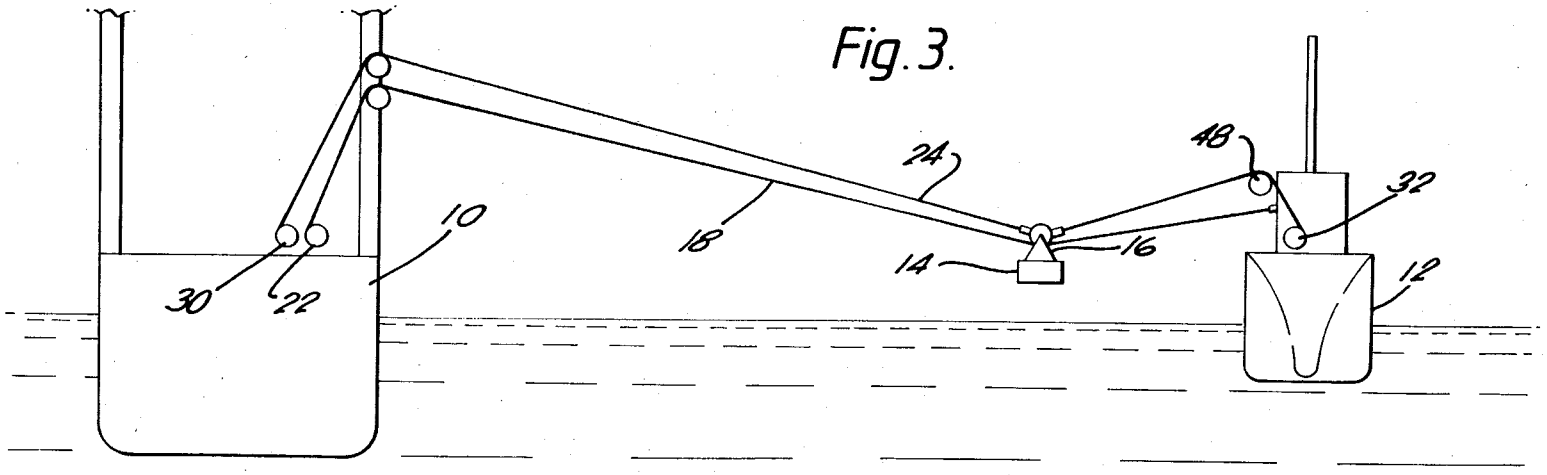

FIG. 3 shows a similar scheme to that shown in FIG. 1 but the outhaul which is on the receiving ship 12.

In both cases, the inhaul winch 26 comprises a DC electric motor (see FIG. 2), preferably controlled by a solid-state speed control system 42 (see FIG. 2) driving the inhaul winch barrel 30. In both cases the outhaul winch 28 comprises an AC pole-changing 2-speed motor 36 (see FIG. 2) driving a hydrokinetic torque convertor 38 (see FIG. 2). The output from the torque convertor 38 drives the outhaul winch barrel 32 through change-speed gearing 40 (see FIG. 2) giving two gear ratios, or if preferred more than two ratios. The gearing 40 can also have a reverse gear facility for use when the system is being assembled. The inhaul and outhaul winches 26, 28 may employ any form of drive input as alternatives to those described. For example, AC or hydraulic for the inhaul winch or DC or hydraulic for the outhaul winch. In both cases, the auto-tensioning winch 20 has a DC electric motor 44 controlled by a thyristor control system 46.

Figure 2:
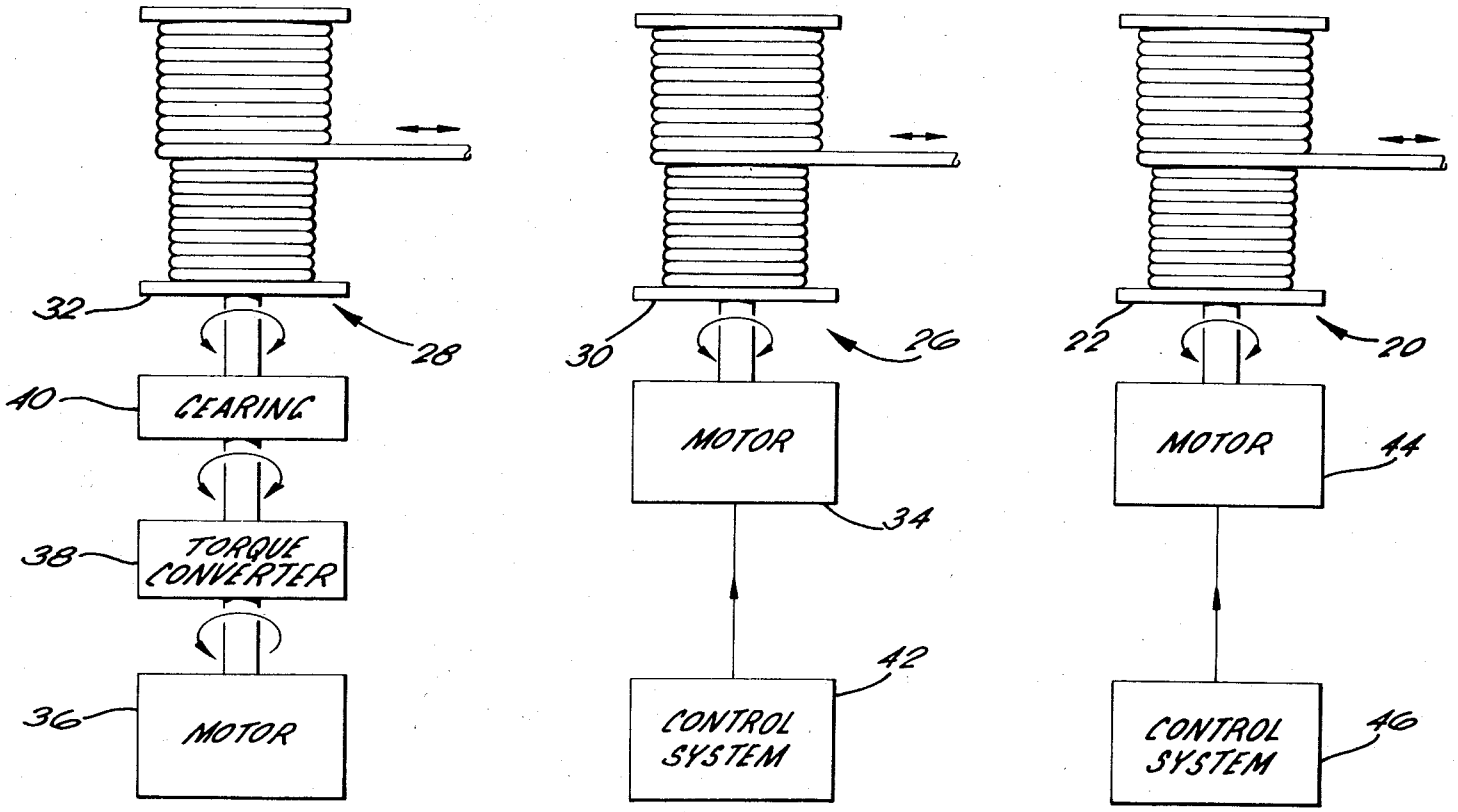
FIG. 2 is a schematic diagram showing a plan view of the winches shown in FIG. 1.

The plan arrangement shown in FIG. 2 would be applicable to the scheme shown in FIG. 3 also, except that the outhaul winch 28 would be located on the ship 12.

The torque convertor 38 is preferably of the kind available from British Twin Disc of Rochester, Kent under the designation "Type 4".

OPERATION

In hauling an empty trolley 16 or any quantity of payload towards the supply ship 10, the outhaul winch 28 is set to provide a relatively light pull on the cable 24 so as to prevent the cable 24 trailing behind the trolley 16 from sagging unduly. The motor 36 is energized in the sense such that the outhaul winch barrel 32 would, if free to do so, wind the cable.

The control system 42 is set such that the inhaul winch motor 34 is energized to drive the inhaul winch barrel 30 at a speed to overcome the pull of the outhaul winch 28, so that the outhaul barrel 32 is forced to pay out cable. The required light pull in the trailing portion of the cable 24 is maintained by the torque convertor 38 and the input drive from the outhaul winch motor 36.

The speed of the approach of the trolley 16 to the supply ship 10 is controlled by the control system 42 controlling the energization of the inhaul winch motor 34 which is driving the inhaul winch barrel 30.

When the empty trolley 16 or a light payload is to be sent to the receiving ship, the same outhaul winch drive setting may be used, but the control system 42 is set to energize the inhaul winch motor 34 to drive the inhaul winch barrel 30 so as to pay out cable.

If desired, the change-speed gearing 40 of the outhaul winch 28 may be set to drive the outhaul winch barrel 32 at a lower gear ratio than before.

When a heavy payload is to be transferred to the receiving ship 12, the outhaul winch 28 may be set to maximum pull, the change-speed gearing 40 being set to give the lower gear ratio and the outhaul winch motor 36 being energised at maximum speed. The gear ratio of the gearing 40 and the speed of winch motor 36 would be selected depending upon the load transferred and the relative heights of the ends of the jackstay cable 18 on each ship.

Speed control as before is by way of the control system 42 which is set to energize the inhaul winch motor 34 to drive the inhaul winch barrel 30 to pay out cable but so as to resist the pull from the outhaul winch 28 so as to control the speed of the payload.

The inhaul winch 26 is thus the master winch so as to control the speed of the trolley 16 whatever the magnitude of the payload and regardless of direction of transfer.

The invention may be applied to transferring loads between ships or between a ship and an oil drilling rig or platform or between a ship and a lightship or lighthouse, for example.

In alternatives, not shown, the jackstay cable 18 may be tensioned by any suitable means which can be manually or automatically controlled, for example a winch having an AC motor, or an hydraulic motor, or a steam-driven winch, or a ram which can be used either with or without such a winch. In another alternative, not shown, the control of the inhaul winch 26 may be automatically regulated according to the motion of the two ships so that as the load approaches either ship its speed is regulated to avoid undesirably harsh contact of the load or the trolley 16 with the ship concerned. In another alternative, not shown, the trolley 16 can be any other suitable payload support means, for example a pulley block having a hook.

What I claim is:

1. A winch system for transferring a load between two spaced-apart stations comprising:

(a) support means for supporting a payload;

(b) a first cable arrangement extending between said stations and upon which said support means is mounted for movement relative to said stations;

(c) a second cable arrangement extending between said stations and being connected to said support means;

(d) an inhaul winch comprising a barrel around which a respective end portion of said second cable arrangement is wound and a motor the output from which selectably positively drives said barrel to take in or to pay out cable of said second cable arrangement, respectively;

(e) an outhaul winch comprising a barrel around which a respective end portion of said second cable arrangement is wound, a torque converter and a motor the output from which during a transfer operation drives said outhaul winch barrel through said torque converter in a sense to take in cable only whereby said outhaul winch provides a preset pull on said support means regardless of the sense of rotation of said outhaul winch barrel; and (f) control means for selectively controlling the speed and sense of rotation of said output of said inhaul winch motor to said inhaul winch barrel, thereby controlling the speed of said support means in the respective sense of movement thereof.

2. A winch system according to claim 1, in which said outhaul winch motor is selected from a two speed motor, a multispeed motor or a variable speed motor.

3. A winch system according to claim 1 or claim 2, in which gearing interconnects said torque converter to said outhaul winch barrel.

4. The winch system according to claim 1, wherein the speed of said inhaul which is controllable by an operator of said control means and the pull of said outhaul winch is not controllable by said operator.

* * * * *